United States Patent [19]

Ghys et al.

[11] 3,980,481

[45] Sept. 14, 1976

[54] DIRECT-POSITIVE SUPER-SENSITIZED SILVER HALIDE EMULSIONS

[75] Inventors: Theofiel Hubert Ghys; Willy Joseph Vanassche, both of Kontich; Herman Alberik Pattyn, Kapellen, all of Belgium

[73] Assignee: AFGA-GEVAERT N.V., Mortsel, Belgium

[22] Filed: Jan. 11, 1974

[21] Appl. No.: 432,534

[30] Foreign Application Priority Data

Jan. 25, 1973 United Kingdom ..... 3904/73

[52] U.S. Cl. ..... 96/101; 96/100; 96/126; 96/129; 96/137

[51] Int. Cl.[2] ..... G03C 1/36

[58] Field of Search ..... 96/101, 137, 126, 129, 96/100

[56] References Cited

UNITED STATES PATENTS

| | | | |
|---|---|---|---|
| 3,501,310 | 3/1970 | Illingsworth et al. | 96/101 |
| 3,567,456 | 3/1971 | Riester et al. | 96/101 |
| 3,598,596 | 8/1971 | Chapman | 96/101 |
| 3,615,610 | 10/1971 | Florens et al. | 96/101 |
| 3,779,776 | 12/1973 | Vanassche et al. | 96/101 |

*Primary Examiner*—J. Travis Brown
*Attorney, Agent, or Firm*—A. W. Breiner

[57] ABSTRACT

Direct-positive silver halide emulsions comprising fogged silver halide grains and an electron acceptor are described wherein the emulsion is spectrally sensitized by means of 2-aryl-indolocarbocyanines. The combination of electron acceptors and these spectral sensitizers provides super-sensitizing effects that are not impaired by the presence of color couplers.

8 Claims, No Drawings

DIRECT-POSITIVE SUPER-SENSITIZED SILVER HALIDE EMULSIONS

The present invention relates to new and improved direct-positive silver halide emulsions.

It is known that direct-positive images can be obtained with certain types of photographic silver halide emulsions without previously forming a negative silver image. For this purpose, the silver halide grains are fogged by an overall-exposure to actinic radiation or by an overall chemical fogging, e.g. by means of reducing agents, before or after they are coated on a support. Upon image-wise exposure of the prefogged emulsions the development centres formed by said fogging are destroyed at the exposed areas and remain at the unexposed areas. By subsequent conventional development by means of silver halide developers a direct-positive image is formed.

A particularly suitable class of direct-positive silver halide emulsions consists of direct-positive silver halide emulsions comprising electron-traps by the presence of electron-accepting compounds which are adsorbed to the surface of the fogged silver halide grains. Electron-accepting compounds are usually characterized as having an anodic polarographic half-wave potential and a cathodic polarographic half-wave potential which, when added together, give a positive sum. These compounds may be spectrally sensitizing electron-acceptors or non-spectrally sensitizing electron-acceptors.

It is known to introduce colour couplers as used in conventional photographic silver halide emulsions into such fogged silver halide emulsions comprising electron-acceptors. However, not all spectrally or non spectrally sensitizing electron-acceptors can be used successfully in the presence of colour couplers in that they are easily desorbed from the silver halide grains by the colour couplers, which results in a reduction of the direct-positive image formation and thus in a reduced photographic speed or in a complete inhibition of the direct-positive image formation.

In U.S. Pat. No. 3,501,312 spectrally sensitizing electron-acceptors have been described and claimed for use in direct-positive silver halide emulsions which are particularly suitable for use together with colour couplers. These spectrally sensitizing electron acceptors are cyanine dyes comprising two indole nuclei, each respective nucleus being joined through the 3-carbon atom thereof to one of the respective terminal carbon atoms of a trimethine chain, at least one of said nuclei being 2-aromatically substituted and having a substituent selected from the group consisting of (1) a fused non-heterocyclic aromatic ring attached to the benzene ring of the indole nucleus, (2) a 1,7-alkylene bridge, and (3) a heterocyclic aromatic nucleus attached to the 2-carbon atom of the indole nucleus. As is illustrated in this United States Patent, corresponding 1-alkyl-2-phenylindole cyanine dyes which do not comprise a substituent selected from the above group e.g. 1,1'-dimethyl-2,2'-diphenyl-3,3'-indolocarbocyanine bromide cannot be used successfully in emulsions containing a colour coupler.

In U.S. Pat. application Ser. No. 269,861 (= published German Patent Application 2,237,036) non-spectrally sensitizing dihydropyrimidine electron-acceptors have been described which are suitable for use in direct-positive silver halide emulsions comprising colour couplers contrary to other well known non-spectrally sensitizing electron-acceptros such as the nitrostyryl dye pinacryptol yellow and the nitrobenzylidene dye 5-m-nitro-benzylidene rhodanine which are sometimes unsuitable for use together with colour couplers.

Surprisingly it has now been found that 2-phenyl-indolo-carbocyanines used together with a non-spectrally sensitizing electron-acceptor, especially a nitrostyryl of nitrobenzylidene electron-acceptor, or an electron-acceptor of the type described in the above U.S. Pat. application Ser. No. 269,861 (= published German Patent Application 2,237,036), in direct-positive silver halide emulsions provide favourable supersensitizing effects. Moreover, incorporation of colour couplers does not reduce spectral sensitization and direct-positive image formation, in the presence of the colour coupler, spectral sensitization is even increased sometimes.

Accordingly, the present invention provides a direct-positive silver halide emulsion comprising a non-spectrally sensitizing electron-acceptor wherein the emulsion also comprises a spectrally sensitizing dye corresponding to the following general formula I:

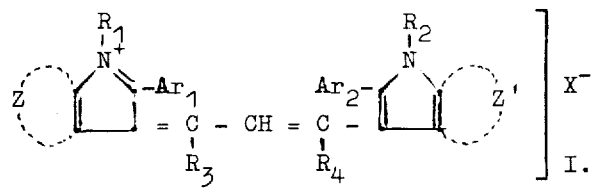

I.

wherein:

each of $R_1$ and $R_2$ represents a substituent as commonly employed in cyanine dyes, especially a saturated or unsaturated aliphatic hydrocarbon group including such substituted group e.g. alkyl including substituted alkyl e.g. methyl, ethyl, propyl, butyl, β-hydroxyethyl, β-acetoxyethyl, sulphoethyl, sulphopropyl, sulphatopropyl, sulphatobutyl, carboxyethyl, carboxybutyl, cyanoethyl, a group —A-$COOBSO_2OH$ wherein each of A and B represents a hydrocarbon group as described in the United Kingdom Patent No. 886,271 or the group —A-W-NH-V-B, wherein A represents methylene, ethylene, propylene, or butylene, B represents alkyl, amino, substituted amino or if V is a single bond hydrogen, and each of W and V represents carbonyl, sulphonyl or a single bond, but at least one of them being sulphonyl as described in United Kingdom Patent No. 904,332, a cycloalkyl group e.g. cyclohexyl and allyl, an aliphatic-aromatic hydrocarbon group including such substituted group e.g. benzyl and carboxybenzyl, an aromatic hydrocarbon group e.g. aryl including substituted aryl e.g. phenyl and carboxyphenyl, each of $R_3$ and $R_4$ represents hydrogen, an alkyl group e.g. methyl, ethyl, propyl, and butyl, a cycloalkyl group e.g. cyclohexyl, a carbocyclic or heterocyclic aryl group e.g. phenyl including substituted phenyl e.g. phenyl substituted by alkyl e.g. methyl, alkoxy, e.g. methoxy, halogen or nitro, and thienyl, each of $Ar_1$ and $Ar_2$ and represents a carbocyclic aryl group including a substituted carbocyclic aryl group e.g. phenyl, naphthyl, tolyl, biphenylyl, alkoxyphenyl, halophenyl, cyanophenyl, nitrophenyl, each of Z and Z′ represents a fused on benzo group or substituted benzo group e.g. substituted by halogen, alkyl, alkoxy, alkylsulphonyl, nitro, etc.

$X^-$ represents an anion e.g. chloride, bromide, iodide, perchlorate, methylsulphate, p-toluene sulphonate, etc. but is not present when $R_1$ or $R_2$ itself contains an anionic group.

Representative examples of dyes corresponding to the above general formula are listed in the following table:

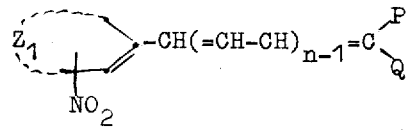

II.

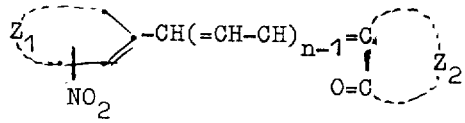

III.

Table

| dye | $R_1$ | $R_2$ | $R_3$ | $R_4$ | Z | Z′ | $Ar_1$ | $Ar_2$ | $X^-$ |
|---|---|---|---|---|---|---|---|---|---|
| 1 | $CH_3$ | $CH_3$ | H | H | benzo | benzo | phenyl | phenyl | $Br^-$ |
| 2 | $CH_3$ | $CH_3$ | phenyl | H | " | " | " | " | $Cl^-$ |
| 3 | $CH_3$ | $CH_3$ | H | H | 5-methoxybenzo | " | " | " | $Br^-$ |
| 4 | $CH_3$ | $CH_3$ | H | H | benzo | " | p-chlorophenyl | p-chlorophenyl | $Cl^-$ |
| 5 | $CH_3$ | $CH_3$ | phenyl | H | " | " | " | " | $ClO_4^-$ |
| 6 | $CH_3$ | $CH_3$ | " | H | " | " | p-methoxyphenyl | p-methoxyphenyl | $ClO_4^-$ |
| 7 | $CH_3$ | $CH_3$ | p-methoxy-phenyl | H | " | " | phenyl | " | $ClO_4^-$ |
| 8 | $CH_3$ | $CH_3$ | H | H | " | " | p-tolyl | p-tolyl | $Br^-$ |
| 9 | $CH_3$ | $CH_3$ | 2-thienyl | H | " | " | p-methoxyphenyl | p-chlorophenyl | $ClO_4^-$ |
| 10 | $CH_3$ | $CH_3$ | H | H | " | " | p-cyanophenyl | p-cyanophenyl | $Br^-$ |
| 11 | $CH_3$ | $CH_3$ | H | H | " | " | biphenylyl | biphenylyl | $Br^-$ |
| 12 | $CH_3$ | $CH_3$ | p-methoxy-phenyl | H | " | " | p-methoxyphenyl | p-methoxyphenyl | $ClO_4^-$ |
| 13 | $CH_3$ | $CH_3$ | " | H | " | " | phenyl | phenyl | $ClO_4^-$ |
| 14 | $CH_3$ | $CH_3$ | H | H | " | " | p-nitrophenyl | p-nitrophenyl | $Br^-$ |
| 15 | $CH_3$ | $CH_3$ | H | H | " | " | p-bromophenyl | p-bromophenyl | $Br^-$ |
| 16 | 2-cyano-ethyl | 2-cyano-ethyl | H | H | " | " | p-chlorophenyl | p-chlorophenyl | $Br^-$ |
| 17 | $CH_3$ | $CH_3$ | H | H | " | " | " | α-naphthyl | $Br^-$ |
| 18 | 2-cyano-ethyl | $CH_3$ | H | H | 5-methylsulphonyl-benzo | " | " | p-chlorophenyl | $Br^-$ |
| 19 | $CH_3$ | $CH_3$ | H | H | benzo | " | p-fluorophenyl | p-fluorophenyl | $Br^-$ |
| 20 | 2-cyano-ethyl | 2-cyano-ethyl | phenyl | H | " | " | p-chlorophenyl | p-chlorophenyl | $ClO_4^-$ |
| 21 | $CH_3$ | $CH_3$ | phenyl | H | " | " | p-fluorophenyl | p-fluorophenyl | $ClO_4^-$ |
| 22 | $CH_3$ | $CH_3$ | p-bromo-phenyl | H | " | " | phenyl | phenyl | $ClO_4^-$ |
| 23 | $CH_3$ | $CH_3$ | " | H | " | " | p-chlorophenyl | p-chlorophenyl | $ClO_4^-$ |
| 24 | $CH_3$ | $CH_3$ | p-nitro-phenyl | H | " | " | " | " | $ClO_4^-$ |
| 25 | $CH_3$ | $CH_3$ | H | H | " | " | p-iodophenyl | p-iodophenyl | $Cl^-$ |
| 26 | $CH_3$ | $CH_3$ | phenyl | H | " | " | " | " | $ClO_4^-$ |
| 27 | $CH_3$ | $CH_3$ | p-nitro-phenyl | H | " | " | p-fluorophenyl | p-fluorophenyl | $ClO_4^-$ |
| 28 | $CH_3$ | $CH_3$ | p-bromo-phenyl | H | " | " | " | " | $ClO_4^-$ |
| 29 | $CH_3$ | $CH_3$ | " | H | 5-nitrobenzo | 5-nitro-benzo | phenyl | phenyl | $ClO_4^-$ |
| 30 | $CH_3$ | $CH_3$ | p-nitro-phenyl | H | 5-fluorobenzo | 5-fluoro-benzo | " | " | $ClO_4^-$ |
| 31 | $CH_3$ | $CH_3$ | p-bromo-phenyl | H | " | " | " | " | $ClO_4^-$ |
| 32 | $CH_3$ | $CH_3$ | p-nitrophenyl | H | 5-nitrobenzo | 5-nitrobenzo | " | " | $ClO_4^-$ |
| 33 | $CH_3$ | $CH_3$ | p-bromophenyl | H | benzo | benzo | p-bromophenyl | p-bromophenyl | $ClO_4^-$ |
| 34 | $CH_3$ | $CH_3$ | p-nitrophenyl | H | " | " | " | " | $ClO_4^-$ |
| 35 | $CH_3$ | $CH_3$ | p-chlorophenyl | H | " | " | phenyl | phenyl | $ClO_4^-$ |
| 36 | $CH_3$ | $CH_3$ | p-bromophenyl | H | " | " | p-methoxy-phenyl | p-methoxyphenyl | $ClO_4^-$ |
| 37 | $CH_3$ | $CH_3$ | p-nitrophenyl | H | " | " | " | " | $ClO_4^-$ |
| 38 | $CH_3$ | $CH_3$ | phenyl | H | " | " | p-bromo-phenyl | p-bromophenyl | $ClO_4^-$ |
| 39 | $CH_3$ | $CH_3$ | p-chlorophenyl | H | " | " | p-chloro-phenyl | p-chlorophenyl | $ClO_4^-$ |
| 40 | $CH_3$ | $CH_3$ | p-iodophenyl | H | " | " | phenyl | phenyl | $ClO_4^-$ |
| 41 | $CH_3$ | $CH_3$ | p-chlorophenyl | H | " | " | p-fluoro-phenyl | p-fluorophenyl | $ClO_4^-$ |
| 42 | $CH_3$ | $CH_3$ | " | H | " | " | p-bromo-phenyl | p-bromophenyl | $ClO_4^-$ |
| 43 | $CH_3$ | $CH_3$ | p-nitrophenyl | H | " | " | phenyl | phenyl | $ClO_4^-$ |

The dyes can be prepared according to methods well known to those skilled in the art and as described e.g. in U.S. Pat. No. 2,930,694.

Especially useful non-spectrally sensitizing electronaccepting compounds for the direct-positive silver halide emulsions according to the present invention are nitrostyryl and nitrobenzylidene dyes as described in U.S. Pat. No. 3,615,610 which can be represented by the following general formulae II – V:

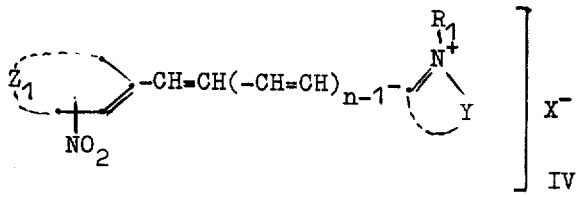

IV.

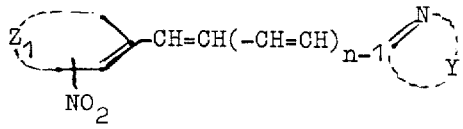

V.

wherein one or more of the methine groups may be substituted e.g. with a cyano group, $R_1$ and $X^-$ have the same significance as described above, Y represents the atoms necessary to complete a heterocyclic nucleus of the type used in the production of cyanine dyes e.g. those of the thiazole, benzothiazole and naphthothiazole series, those of the oxazole, benzoxazole, and naphthoxazole series, those of the selenazole, benzoselenazole, and naphthoselenazole series, those of the thiadiazole series, those of the 2-quinoline series, those of the pyrimidine series, those of the quinoxaline series, those of the quinazoline series, those of the 1-phthalazine series, those of the 2-pyridine series and those of the benzimidazole series, $Z_1$ represents the necessary atoms to close an aromatic nucleus e.g. a benzene nucleus, which may be further substituted e.g. with another nitro group, each of P and Q represents an organic group with electronegative character e.g.

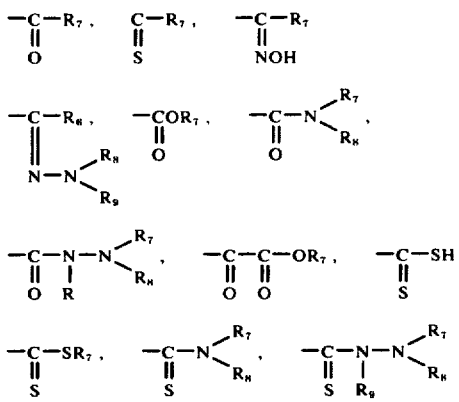

(wherein each of $R_7$, $R_8$ and $R_9$ represents a hydrogen atom, an alkyl group, an aryl group, an aralkyl group, or a heterocyclic group, which groups may be substituted), $—NO_2$, —CN, an aromatic homocyclic monovalent group e.g. phenyl or naphthyl, which group may be substituted preferably with an electronegative group as hereinbefore described or a monovalent heterocyclic group with aromatic character e.g. a furyl, thienyl, pyrrolyl, indolyl, or

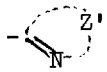

group, wherein Z′ represents the necessary atoms to close a heterocyclic nucleus with aromatic character, which groups may be substituted, $Z_2$ represents the necessary atoms to close a cyclic ketomethylene nucleus such as one of those of the pyrazolone series e.g. 3-methyl-1-phenyl-5-pyrazolone, 1-phenyl-5-pyrazolone, 1-(2-benzothiazolyl)-3-methyl-5-pyrazolone, those of the isoxazolone series e.g., 3-phenyl-5-isoxazolone, or 3-methyl-5-isoxazolone, those of the oxindole series, e.g. 1-alkyl-2,3-dihydro-2-oxindoles, those of the 2,4,6-triketohexahydropyrimidine series e.g. barbituric acid or 2-thiobarbituric acid as well as their derivatives such as those substituted in the 1-position by an alkyl group such as a methyl group, an ethyl group, an 1-n-propyl group, and a 1-n-heptyl group, or those substituted in the 1- and 3-position by an alkyl group, or those substituted in the 1- or 3-position by a β-methoxy-ethyl group, or those substituted in the 1- and 3-position by an aryl group such as phenyl group, or those substituted in the 1- and 3-position by a substituted phenyl group such as a p-chlorophenyl group, or a p-ethoxycarbonyl-phenyl group, or those substituted only in the 1-position by a phenyl-, p-chlorophenyl-, or p-ethoxycarbonylphenyl group, further the mixed alkyl-aryl-substituted derivatives such as 1-ethyl-3-phenyl, and 1-n-heptyl-3-phenyl derivatives, those of the rhodanine series i.e., 2-thio-2,4-thiazolidine-dione series, e.g. rhodanine, and aliphatically substituted rhodanines e.g., 3-ethyl-rhodanine, or 3-allylrhodanine, those of the imidazo[1,2-a]pyridone series, those of the 5,7-dioxo-6,7-dihydro-5-thiazole[3,2-a]pyrimidine series e.g. 5,7-dioxo-3-phenyl-6,7-dihydro-5-thiazolo[3,2-a] pyrimidine, those of the 2-thio-2,4-oxazolidinedione series i.e. those of the 2-thio-2,4-oxazoledione series e.g. 3-ethyl-2-thio-2,4-oxazolidinedione, those of the thianaphthenone series e.g. 3-thianaphthenone, those of the 2-thio-2,5-thiazolidinedione series i.e. the 2-thio-2,5-thiazoledione series e.g. 3-ethyl-2-thio-2,5-thiazolidinedione, those of the 2,4-thiazolidinedione series e.g. 2,4-thiazolidinedione, 3-ethyl-2,4-thiazolidinedione, 3-phenyl-2,4-thiazolidinedione, 3-α-naphthyl-2,4-thiazolidinedione, those of the thiazolidone series e.g. 4-thiazolidone, 3-ethyl-4-thiazolidone, 3-phenyl-4-thiazolidone, 3-α-naphthyl-4-thiazolidone, those of the 4-thiazolone series e.g. 2-ethylmercapto-4-thiazolone, 2-alkylphenylamine-4-thiazolones, 2-diphenylamino-4-thiazolone, those of the 2-imino-2,4-oxazolinone i.e. pseudohydantoin series, those of the 2,4-imidazolinedione (hydantoin) series e.g. 2,4-imidazolinedione, 3-ethyl-2,4-imidazolinedione, 3-phenyl-2,4-imidazolinedione, 3-α-naphthyl-2,4-imidazolinedione, 1,3-diethyl-2,4-imidazolinedione, 1-ethyl-3-phenyl-2,4-imidazolinedione, 1-ethyl-3-α-naphthyl-2,4-imidazolinedione, 1,3-diphenyl-2,4-imidazolinedione, those of the 2-thio-2,4-imidazolinedione (i.e. 2-thiohydantoin) series, e.g., 2-thio-2,4-imidazolinedione, 3-ethyl-2-thio-2,4-imidazolinedione, 3-phenyl-2-thio-2,4-imidazolinedione, 3-α-naphthyl-2-thio-2,4-imidazolinedione, 1,3-diethyl-2-thio-2,4-imidazolinedione, 1-ethyl-3-phenyl-2-thio-2,4-imidazolinedione, 1-ethyl-3-α-naphthyl-2-thio-2,4-imidazolinedione, 1,3-diphenyl-2-thio-2,4-imidazolinedione, those of the 5-imidazolone series e.g. 2-n-propylmercapto-5-imidazolone, and those of the homocyclic ring systems represented by the following structural formulae:

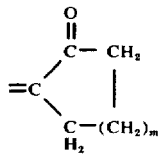

wherein *m* represents 1, 2, or 3,

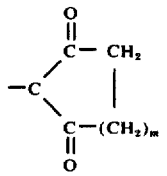

wherein *m* represents 1, 2, or 3,

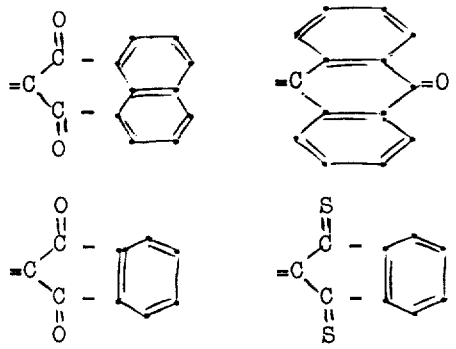

or

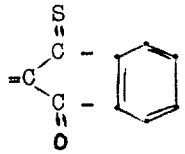

*n* represents a positive integer 1 or 2.

Particularly suitable compounds according to said general formulae II to V are:

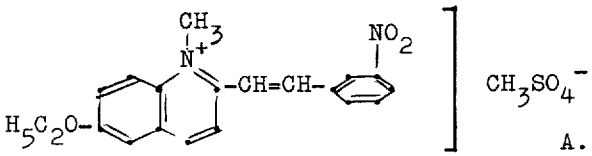

A.

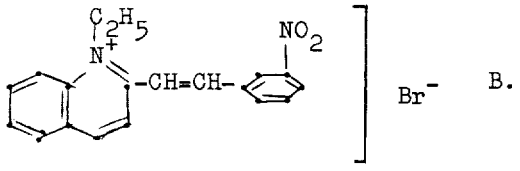

B.

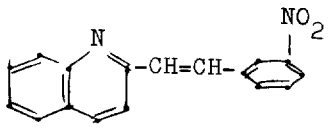

C.

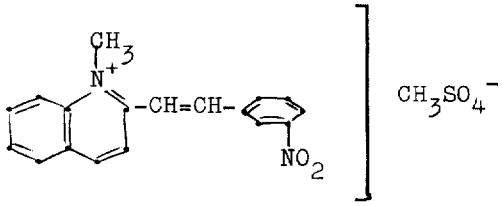

D.

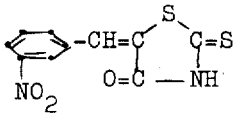

E.

Other very suitable non-spectrally sensitizing electron-accepting compounds for the direct-positive silver halide emulsions according to the present invention are the dihydropyrimidine compounds of U.S. Pat. application Ser. No. 269,861 (= published German Patent Application No. 2,237,036) which correspond to one of the following general formulae VI or VII or a tautomeric form thereof:

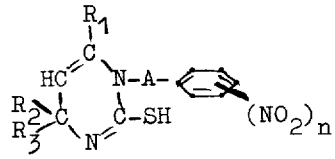

VI.

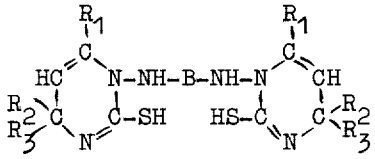

VII.

wherein:

$R_1$ is hydroxyl or $C_1$-$C_5$ alkyl, $R_2$ is hydrogen or $C_1$-$C_5$ alkyl, $R_3$ is $C_1$-$C_5$ alkyl or aryl, A is a single bond or NH, B is a phenyl or diphenyl sulphone group in which the or both phenyl groups are substituted with one or more nitro groups, and

*n* is 1, 2 or 3.

As is known from this United States Patent Application, the compounds corresponding to the above general formulae VI and VII are not only suitable for use as such but it is also possible to use the corresponding disulphides thereof or precursor compounds e.g. compounds corresponding to the above formulae VI or VII or a tautomeric form thereof wherein the tautomeric hydrogen atom is replaced by a —COR′ group in which R′ represents alkyl, aryl, aralkyl or a residue identical to the diazine residue linked to the carbonyl group of —COR, by a $—SO_2R''$ group in which R″ is alkyl, aryl or aralkyl or by a COOR‴ group wherein R‴ is alkyl or aryl.

A particularly suitable dihydropyrimidine compound has the following structural formula:

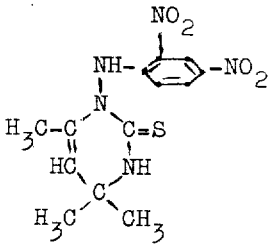

F.

Other examples of non-spectrally sensitizing electron acceptors include 2,3,5-triphenyl-2H-tetrazolium chloride, 2-(4-iodophenyl)-3-(4-nitrophenyl)-5-phenyl tetrazolium chloride, 1-methyl-8-nitroquinolinium methyl sulphate, 1-m-nitrobenzyl-quinolinium chloride, 1-m-nitrobenzylpyridinium chloride, 1-p-nitrobenzylisoquinolinium chloride, 1-p-nitrobenzylbenzo[f]quinolinium chloride and 1-methyl-2-m-nitrostyrylquinolinium methyl sulfate.

The spectrally sensitizing dye as well as the non-spectrally sensitizing electron-acceptor can be incorporated into the silver halide emulsions according to methods well known to those skilled in the art of emulsion making e.g. from solutions in appropriate solvents such as water, methanol, ethanol, pyridine, etc. or mixtures of solvents.

The spectrally sensitizing dyes of the above formula I and the non-spectrally sensitizing electron acceptors can be used in widely varying concentrations. They are generally used in amounts varying from about 50 mg to about 2 g per mole of silver halide. The ratio of spectrally sensitizing dye to non-spectrally sensitizing electon-acceptor is preferably comprised between about 1:5 and about 5:1.

The combination of spectrally sensitizing dye corresponding to the above formula I and non-spectrally sensitizing electronacceptor is espcially useful in direct-positive silver halide emulsions containing colour couplers. In view of the spectral sensitization range of the sensitizing dyes, the colour couplers are of the type forming upon development with an aromatic primary amino colour developing agent cyan dyestuffs i.e. the well known colour couplers of the phenol or naphthol type. Especially suitable colour couplers can be represented by the formula:

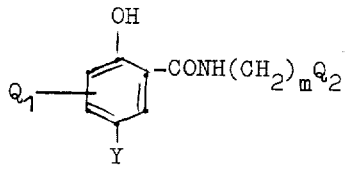

wherein:

$Q_1$ represents hydrogen, a substituent of the type well known in phenol colour couplers such as halogen, alkyl or aryl, or the atoms necessary to complete a fused-on benzene nucleus which may be substituted,

*m* is 0, 1, 2 or 3, $Q_2$ is an alkyl group of at least 8 C-atoms, an acyl group, an acylamino group, an acylamino aryl group, an alkylamino aryl group, an alkoxy group, aryloxy group or an aryloxyaryl group wherein the aryl or alkyl groups may comprise a carboxy or sulpho group in acid or salt form, $Q_2$ preferably comprising at least one aliphatic straight-chain or branched-chain hydrocarbon group of at least 5C-atoms rendering the molecule fast to diffusion in the silver halide emulsion layer, and Y represents hydrogen in the case of 4-equivalent couplers or a substituent which splits off upon colour development thus conferring to the colour coupler a 2-equivalent character e.g. a sulpho group in acid or salt form, a halogen atom such as chlorine, an acyloxy group, an alkoxy group, an aryloxy group, a heterocycloxy group, an alkylthio group, an arylthio group, a heterocyclic thio group such as tetrazolylthio or a phenylazo group, etc.

The colour couplers preferably have a low halogen accepting character which can be determined by the test described by R. P. Held in Phot.Sci.Eng. Vol. 11, (1967) p. 406. For this purpose a dispersion of silver bromide grains in buffered 0.1 N potassium bromide is illuminated and the potential is registered by means of a calomel/platinum electrode system. During illumination the platinum electrode potential rises rapidly to the redox potential of bromine. On addition of a colour coupler the potential rise can be delayed through "halogen acceptance" by the colour coupler. Colour couplers that do not delay or do not substantially delay the potential rise are particularly suitable for use in the direct-positive silver halide emulsions of the invention.

The colour couplers can be incorporated into the direct-positive photographic silver halide emulsion according to any suitable technique known to those skilled in the art for incorporating colour couplers in silver halide emulsions. For example, water-soluble colour couplers, e.g. those containing one or more sulpho or carboxyl groups (in acid or salt form), can be incorporated from an aqueous solution, if necessary, in the presence of alkali, and the water-insoluble or insufficiently water-soluble colour couplers from a solution in the appropriate water-miscible or water-immiscible high-boiling (oil-former) or low-boiling organic solvents or mixtures of solvents, which solution is dispersed, if necessary in the presence of a surface-active agent, in a hydrophilic colloid composition forming or forming part of the binding agent of the silver halide emulsion; if necessary, the low-boiling solvent is removed afterwards by evaporation.

The direct-positive silver halide emulsions can be prepared according to known methods. The silver halide composition may consist of any of the known silver halides suitable for the formation of direct-positive silver halide emulsions e.g. silver bromide, silver chloride, silver chlorobromide, silver bromoiodide and silver chlorobromoiodide. Emulsion blends can also be used e.g. blends of silver chloride and silver chlorobromide. The silver halide preferably comprises at most 20 mole % of silver iodide which may be located mainly towards the surface of the grains as described in German Patent Application No. P 22 60 177.8.

Especially suitable for use according to the present invention are direct-positive silver halide emulsions the silver halide grains of which have an average grain-size of less than about 1 micron. The silver halide grains can be regular and have one of the commonly known shapes e.g. cubic, octahedral, and even rhombohedral. They may have a substantially uniform diameter frequency distribution e.g. 95 % weight by weight of the silver halide grains can have a diameter which is within about 40 %, preferably within about 30 % of the mean grain diameter.

The silver halide grains of the direct-positive silver halide emulsions of the present invention are fogged according to methods well known in the art. They may be fogged e.g. by an overall exposure to actinic radiation or by reduction sensitization e.g. by high pH and/or low pAg silver halide precipitating or digestion conditions e.g. as described by Wood, J.Phot.Sci. 1 (1953) 163, or by treatment with reducing agents. Fogging may also occur by reduction sensitization in the presence of a compound of a metal more electropositive than silver.

Reducing agents suitable for use include hydrazine, hydroxylamine, tin(II) compounds e.g. tin(II) chloride, tin complexes and tin chelates of the (poly)amino(poly)carboxylic acid type as described in United Kingdom Patent 1,209,050, ascorbic acid, formaldehyde, thiourea dioxide, polyamines such as diethylene triamine, phosphonium salts such as tetra(hydroxymethyl)phosphonium chloride, bis(p-aminoethyl) sulphide and its water-soluble salts, etc. Preferred reducing agents are thiourea dioxide and tin(II) chloride.

The compounds of a metal more electropositive than silver include gold compounds e.g. gold(III)chloride, potassium chloroaurate, potassium chloroaurite, and potassium aurithiocyanate, as well as compounds of rhodium, platinum, iridium, and palladium, e.g. ammonium hexachloropalladate and potassium chloroiridate. Preferred noble metal compounds are gold compounds.

When fogging of the silver halide grains occurs by means of a reducing agent e.g. thiourea dioxide and a compound of a metal more electropositive than silver especially a gold compound, the reducing agent is preferably used initially and the gold compound subsequently. However, the reverse order can be used or both compounds can be used simultaneously.

The degree of fogging of the direct-positive emulsions used according to the invention may vary within a wide range. This degree of fogging depends, as is known in the art, on the concentration of the fogging agents used as well as on the pH, the pAg, the temperature and the duration of the fogging treatment.

As is known in the art, high photographic speeds can be obtained at low degrees of fogging. Thus, the direct-positive silver halide emulsions of the invention can be fogged, as is described in U.S. Pat. No. 3,501,307, to such a degree that a test-portion of the silver halide emulsion, comprising the fogged silver halide grains and a compound accepting electrons, when coated on a support to give a maximum density of at least about one upon processing for 6 minutes at about 20°C in a developer of the composition given below, has a maximum density which is at least about 30 % greater than the maximum density of an identical test portion processed for 6 minutes at about 20°C in the same developer after being bleached for about 10 minutes at about 20°C in a bleach of the composition given below:

| | |
|---|---|
| bleach: | |
| potassium cyanide | 50 mg |
| glacial acetic acid | 3.47 ml |
| sodium acetate | 11.49 g |
| potassium bromide | 119 mg |
| water to make | 1 liter |
| developer: | |
| N-methyl-p-aminophenyl sulphate | 2.5 g |
| sodium sulphite | 30.0 g |
| hydroquinone | 2.5 g |
| sodium metaborate | 10.0 g |
| potassium bromide | 0.5 g |
| water to make | 1 liter |

In order to further enhance the photographic speed, the silver halide grains of the direct-positive silver halide grains of the present invention may be fogged even to a degree where strictly speeking no fogging as defined in the said U.S. Pat. No. 3,501,307 is observed, e.g. as described in co-pending United Kingdom Patent Application No. 7742/72. According to this co-pending application the silver halide grains are fogged to such an extent that a test portion of the emulsion ready for coating, when coated on a support at a coverage of 0.50 g to 5.50 g of silver per sq.m gives a density of less than 0.50 upon processing without exposure for 6 min. at 20°C in the above developer and an identical test portion thereof when coated in an identical way gives a density of at least twice the value of the density of the first test portion and a density of at least 0.50 upon processing without exposure for 3 minutes at 20°C in a developer of the following composition:

| | |
|---|---|
| hydroquinone | 15 g |
| 1-phenyl-3-pyrazolidinone | 1 g |
| trisodium salt of ethylene diamine tetraacetic acid | 1 g |
| anhydrous sodium carbonate | 30 g |
| anhydrous sodium sulphite | 70 g |
| 40% aqueous sodium hydroxide | 16 ml |
| water to make | 1 liter (pH : 11) |

When the silver halide grains have been fogged too heavily it is also possible to treat the fogged silver halide grains with a bleaching agent in order to obtain optimum sensitivity.

In view of the foregoing, the terms "fogged" and "fogging" as used herein are employed in a very broad sense so that the very low degrees of fogging as defined in the above copending United Kingdom Patent Application are also embraced which means that fogging is effected to such extent that a test portion of the emulsion when coated as described above gives a density of at least 0.50 upon processing for 3 min. at 20°C in the above latter developer composition.

When the silver halide grains are fogged to a very low degree it is advantageous to develop the exposed direct-positive silver halide emulsions substantially in the absence of halide ions as described in United Kingdom Patent Application No. 7743/72.

The speed and stability of the direct-positive silver halide emulsions according to the present invention can also be enhanced by increasing the pAg of the emulsion just before coating, preferably after addition of the non-spectrally sensitizing electron-acceptor and the spectrally sensitizing dye. Favourable photographic speeds are obtained when the pAg is adjusted, before coating, to a value corresponding to an E.M.F. of + 30 mV or lower (silver against saturated calomel electrode). It is also favourable to further enhance the speed to lower the pH of the emulsion just before coating for example to a pH of at least about 5 as described in United Kingdom Patent Application No. 32889/72.

In the formation of the direct-positive silver halide emulsions used according to the present invention various colloids can be used as vehicles or binding agents for the silver halide. They include any of the hydrophilic colloids generally employed in the photographic field for example gelatin. However, the gelatin may be replaced wholly or partly by other natural hydrophilic colloids, e.g. albumin, zein, agar-agar, gum arabic, alginic acid, and derivatives thereof, such as esters, amides and salts thereof etc., or synthetic hydrophilic resins; e.g. polyvinyl alcohol and poly-N-vinyl pyrrolidone, acrylamide polymers, cellulose ethers, partially hydrolyzed cellulose acetate and the like.

In addition to the hydrophilic binding agents other synthetic binding agents can be employed in the emulsion e.g. homo- and copolymers of acrylic or methacrylic acid or derivatives thereof such as esters, amides and nitriles and vinyl polymers for example vinyl esters and vinly ethers.

The direct-positive photographic silver halide emulsions can be coated on a wide variety of supports which include opaque supports e.g. paper and metal supports as well as transparent supports e.g. glass, cellulose nitrate film, cellulose acetate film, cellulose aceto-butyrate film, polyvinyl acetal film, polystyrene film, polyethylene terephthalate film, polycarbonate film, and other polyester film. It is also possible to employ paper coated with $\alpha$-olefin polymers e.g. paper coated with polyethylene,polypropylene, ethylene-butylene copolymers and the like.

The silver halide emulsion may further contain any of the ingredients generally employed in silver halide emulsions. They may comprise speed increasing agents of the polyalkylene oxide type e.g. polyethylene glycols and derivatives thereof, quaternary ammonium and phosphonium compounds as well as ternary sulphonium compounds, thioether compounds, etc. The emulsions can comprise the common emulsion stabilizing agents, e.g. mercury compounds which include homopolar or salt-like compounds of mercury and aromatic or heterocyclic compounds such as mercaptotriazoles, simple mercury salts, sulphonium mercury double salts, etc. They may comprise azaindene emulsion stabilizers for example tetra- or pentaazaindenes especially those comprising hydroxyl or amino groups as described by Birr, Z.Wiss.Phot. 47 (1962) 2-58. Other suitable emulsion stabilizers are heterocyclic mercapto compounds e.g. 1-phenyl-5-mercaptotetrazole, quaternary benzthiazolium derivatives, benztriazole and the like.

The silver halide emulsion layer and any other hydrophilic colloid layer, which may be present in a direct-positive photographic material employed in accordance with the present invention, may be hardened by means of organic or inorganic hardeners commonly employed in photographic silver halide elements, e.g. the aldehydes and blocked aldehydes such as formaldehyde, dialdehydes, hydroxyaldehydes, mucochloric and mucobromic acid, acrolein, glyoxal, sulphonyl halides, vinylsulphones, etc.

The direct-positive photographic silver halide elements may further contain antistatic agents, wetting agents as coating aids, e.g. saponin and synthetic surface-active compounds, plasticizers, matting agents, e.g. starch, silica, polymethyl methacrylate, zinc oxide, titanium dioxide, etc., optical brightening agents including stilbene, triazine, oxazole, and coumarin brightening agents, light-absorbing materials and filter dyes, mordanting agents, for anionic compounds, etc.

The following examples illustrate the present invention.

EXAMPLE 1

A monodisperse, cubic direct-positive photographic silver bromoiodide emulsion (2.5 mole % of iodide) having an average grain size of about 0.2 micron, was prepared under controlled pH, pAg, and temperature conditions during precipitation of the silver halide. The pH was maintained at 5.5, the pAg at 8.2 and the temperature at 45°C. After adjustment of the pAg to 10, the emulsion was chill-set, shredded, and washed with cold water.

The emulsion was reduction- and gold-fogged by adjustment of the pAg to 5.3 and the pH to 7, by heating for 90 min. at 60°C and by the addition of 30 mg of chloroaurate per mole of silver halide. Heating was continued for 80 minutes at 60°C whereupon the pAg was adjusted to 8.2 at 35°C.

The emulsion was divided into several aliquot samples of 100 g comprising 0.15 mole of silver halide. To each sample one of the dyes referred to hereinbefore and/or one of the electron acceptors referred to hereinbefore were added as listed in the table below. Then the emulsion samples were coated on a subbed support and dried.

The direct-positive elements obtained were exposed in a spectrograph and developed in a conventional developer. Direct-positive spectrograms were obtained which showed that the emulsions comprising both the spectral sensitizer and the non-spectrally sensitizing electron-acceptor had high spectral sensitivity in the red region of the spectrum. The relative values of the overall speed are listed in the following table; a relative value of 100 has been given to the overall speed of the emulsion comprising electron-acceptor A alone.

Table

| Emulsion sample | Dye | Electron-acceptor | Relative speed | Sensitization maximum |
|---|---|---|---|---|
| I | — | 87.5 mg of electron-acceptor A | 100 | — |
| II | 50 mg of dye 4 | — | 560 | 640 nm |
| III | 50 mg of dye 4 | 87.5 mg of electron-acceptor A | 1100 | 640 nm |
| IV | 50 mg of dye 4 | 87.5 mg of electron-acceptor F | 1600 | 640 nm |

EXAMPLE 2

Example 1 was repeated with the only difference that the dyes and/or electron-acceptors listed in the following table were added to the emulsion samples and that to one emulsion sample a colour coupler of the following formula was added in an amount of 7 g:

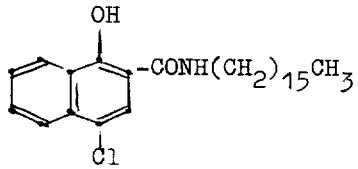

The following results were attained:

| Emulsion sample | Dye | Electron-acceptor | Relative speed | Sensitization maximum |
|---|---|---|---|---|
| I | — | 87.5 mg of electron-acceptor A | 100 | — |
| II | 25 mg of dye 5 | — | 1100 | 670 nm |
| III | 25 mg of dye 5 | 87.5 mg of electron-acceptor A | 1600 | 670 nm |
| IV | 25 mg of dye 5 | 87.5 mg of electron-acceptor F | 3200 | 670 nm |
| V (comprising colour coupler) | 25 mg of dye 5 | 87.5 mg of electron-acceptor F | 6400 | 670 nm |

The above results show the favourable effect of the combination according to the present invention on the overall speed. They also show that the colour coupler also has a favourable effect on the speed.

EXAMPLE 3

Example 2 was repeated with the only difference that the dyes, electron-acceptors and/or colour couplers listed in the following table were added to the emulsion samples of 100 g comprising 0.15 mole of silver halide. The dyes were added in amounts of 37.5 mg, the electron-acceptors in amounts of 87.5 mg and the colour couplers in amounts of 7 g.

Colour coupler I having the following structural formula:

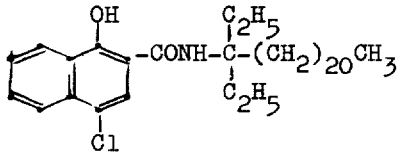

was incorporated into the emulsion samples from a dispersion in water prepared as follows. A solution (60°C) of 10 g of the colour coupler in 30 ml of ethylacetate comprising 0.9 g of sorbitan-monopalmitate was dispersed by means of a high pressure of homogenizer in 70 ml of water (60°C) comprising 3.7 ml of a 10 % aqueous solution of sodium n-lauryl sulphate whereupon the ethylacetate was removed by evaporation under reduced pressure and the dispersion diluted with water to make 100 ml.

Colour coupler II having the following structural formula:

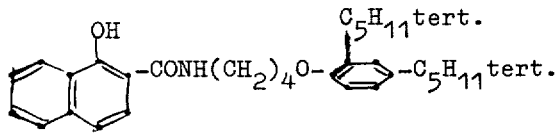

was incorporated into the emulsion samples from a dispersion in aqueous gelatin prepared as follows: A solution (60°C) of 5 g of the colour coupler in 15 ml of ethyl acetate comprising 5 g of di-n-butyl phthalate was dispersed in 50 g of a 10 % aqueous gelatin solution (60°C) comprising 5 ml of a 10 % aqueous solution of a sodium alkylbenzene sulphonate whereupon the ethyl acetate was removed by evaporation under reduced pressure and the dispersion diluted with water to make 1 kg.

The results attained are listed in the following table. The values given for the speed are relative values, the speed of the emulsion comprising the electron-acceptor A alone has been given the value 100.

| Emulsion | Dye | Electron-acceptor | Colour coupler | Relative speed |
|---|---|---|---|---|
| 1 | — | A | — | 100 |
| 2 | — | E | — | 200 |
| 3 | — | F | — | 200 |
| 4 | 23 | — | — | 800 |
| 5 | 24 | — | — | 400 |
| 6 | 26 | — | — | 560 |
| 7 | 2 | — | — | 560 |
| 8 | 23 | A | — | 800 |
| 9 | 23 | E | — | 1400 |
| 10 | 23 | F | — | 2200 |
| 11 | 23 | A | I | 800 |
| 12 | 23 | A | II | 1400 |
| 13 | 23 | E | I | 2200 |
| 14 | 23 | E | II | 1400 |
| 15 | 24 | A | — | 560 |
| 16 | 24 | E | — | 800 |
| 17 | 24 | F | — | 800 |
| 18 | 24 | A | I | 560 |
| 19 | 24 | A | II | 560 |
| 20 | 24 | E | I | 1100 |
| 21 | 24 | E | II | 1100 |

-continued

| Emulsion | Dye | Electron-acceptor | Colour coupler | Relative speed |
|---|---|---|---|---|
| 22 | 24 | F | I | 1600 |
| 23 | 24 | F | II | 800 |
| 24 | 26 | A | — | 1100 |
| 25 | 26 | E | — | 1600 |
| 26 | 26 | F | — | 1600 |
| 27 | 26 | A | I | 1100 |
| 28 | 26 | E | I | 1600 |
| 29 | 26 | F | I | 1600 |
| 30 | 2 | A | — | 1100 |
| 31 | 2 | E | — | 1600 |
| 32 | 2 | F | — | 1600 |
| 33 | 2 | A | I | 1100 |
| 34 | 2 | E | I | 1600 |
| 35 | 2 | F | I | 2200 |

The above results show that the combination of electron-acceptors and spectrally sensitizing dyes according to the present invention can be used successfully in the presence of colour couplers. In the presence of the colour couplers the overall speed is often increased.

The emulsions comprising the dyes identified in the above table have the following spectral sensitivity range and sensitization maxima.

| Dye | Spectral range nm | Sens. max. nm |
|---|---|---|
| 23 | 580–720 | 680 |
| 24 | 590–740 | 690 |
| 26 | 560–720 | 670 |
| 2 | 560–725 | 660 |

We claim:

1. A direct-positive photographic element comprising a support and at least one direct-positive silver halide emulsion layer containing fogged silver halide grains and a non-spectrally sensitizing electron-acceptor selected from the group consisting of nitrostyryl, nitrobenzylidene, dihydropyrimidine, 2,3,5-triphenyl-2H-tetrazolium chloride, 2-(4-iodophenyl)-3-(4-nitrophenyl)-5-phenyl tetrazolium chloride, 1-methyl-8-nitroquinolinium methyl sulphate, 1-m-nitrobenzylquinolinium chloride, 1-m-nitrobenzylpyridinium chloride, 1-p-nitro-benzylisoquinolinium chloride, 1-p-nitrobenzylbenzo quinolinium chloride, and 1-methyl-2-m-nitrostyrylquinolinium methyl sulphate, wherein the emulsion includes a spectrally sensitizing dye of the formula:

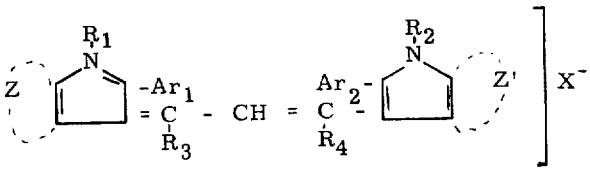

wherein:

each of $R_1$ and $R_2$ represents an aliphatic hydrocarbon group, an aliphaticaromatic hydrocarbon group or an aromatic hydrocarbon group, one of said $R_1$ and $R_2$ optionally including an anion, each of $R_3$ and $R_4$ represents hydrogen, alkyl, cycloalkyl, or a carbocyclic or heterocyclic aryl group, each of $Ar_1$ and $Ar_2$ represents a carbocyclic aryl group, each of Z and Z' represents a fused on benzo group, and $X^-$ is an anion but is not present when $R_1$ or $R_2$ contains an anionic group, said non-spectrally sensitizing electron-acceptor and said spectrally sensitizing dye within said formula selected to provide to said direct-positive photographic element a supersensitizing effect.

2. A direct-positive photographic element according to claim 1, wherein the non-spectrally sensitizing electronacceptor is a nitrostyryl or nitrobenzylidene dye.

3. A direct-positive photographic element according to claim 2, wherein the said nitrostyryl or nitrobenzylidene dye corresponds to one of the following formulae:

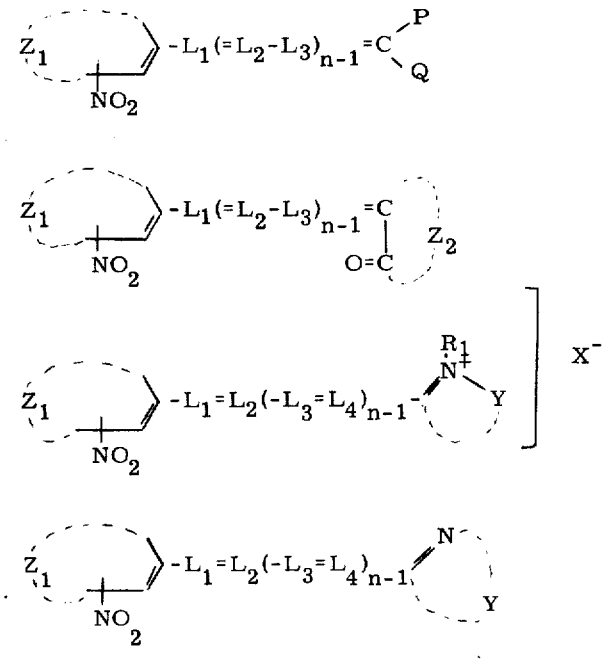

wherein:

$R_1$ represents an aliphatic, aliphatic-aromatic or aromatic hydrocarbon group which may include an anion, $X^-$ is an anion but is not present when $R_1$ contains an anionic group, each of $L_1$–$L_4$ represents a methine group, Y represents the atoms necessary to complete a 5- or 6-membered heterocyclic nucleus of the type used in cyanine dyes, $Z_1$ represents the atoms necessary to close an aromatic nucleus, each of P and Q represents an organic group with electronegative character, and $Z_2$ represents the atoms necessary to close a cyclic ketom ethylene nucleus.

4. A direct-positive photographic element according to claim 1, wherein the non-spectrally sensitizing electronaccepting compound is a dihydropyrimidine compound corresponding to one of the following formulae or a tautomeric form thereof:

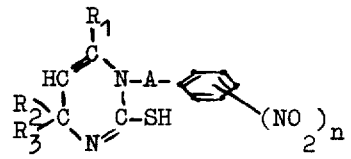

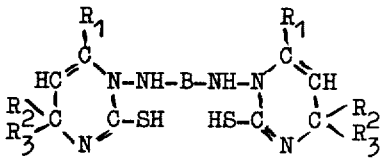

wherein:

$R_1$ is hydroxyl or $C_1$-$C_5$ alkyl, $R_2$ is hydrogen or $C_1$-$C_5$ alkyl, $R_3$ is $C_1$-$C_5$ alkyl or aryl, A is a single bond or NH, B is a phenyl or diphenyl sulphone group in which the or both phenyl groups are substituted with one or more nitro groups, and

*n* is 1, 2 or 3.

5. A direct-positive photographic element according to claim 4, wherein the said dihydropyrimidine compound corresponds to the formula:

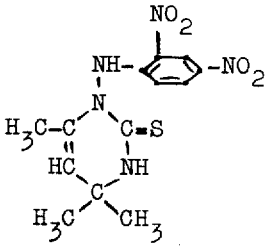

6. A direct-positive photographic element according to claim 1, wherein the said emulsion layer comprises a colour coupler.

7. A direct-positive photographic element according to claim 6, wherein the said colour coupler is a phenol or naphthol colour coupler.

8. A direct-positive photographic element according to claim 7, wherein the said colour coupler corresponds to the formula:

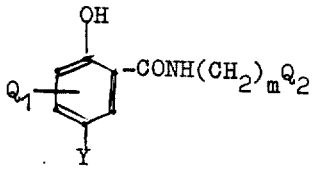

wherein:

$Q_1$ represents hydrogen, halogen, alkyl, aryl or fused-on benzene,

*m* is 0, 1, 2 or 3, $Q_2$ is alkyl, acyl, acylamino, acylaminoaryl, alkylaminoaryl, alkoxy, aryloxy or aryloxyaryl, and Y is hydrogen or a substituent which splits off upon colour development and confers to the colour coupler a 2-equivalent character.

* * * * *